US007121443B2

(12) United States Patent
Sun et al.

(10) Patent No.: US 7,121,443 B2
(45) Date of Patent: Oct. 17, 2006

(54) ELECTRIC NAILING APPARATUS

(75) Inventors: Pei-Li Sun, Taichung (TW); Ching-Yi Chen, Taichung (TW)

(73) Assignee: An Puu Hsin Co., Ltd., Taichung (TW)

( * ) Notice: Subject to any disclaimer, the term of this patent is extended or adjusted under 35 U.S.C. 154(b) by 41 days.

(21) Appl. No.: 11/070,861

(22) Filed: Mar. 2, 2005

(65) Prior Publication Data

US 2006/0196911 A1 Sep. 7, 2006

(51) Int. Cl.
*B25C 1/06* (2006.01)

(52) U.S. Cl. ..... 227/131; 227/2

(58) Field of Classification Search ..... 227/2, 227/8, 131, 129; 173/2, 205, 217, 122
See application file for complete search history.

(56) References Cited

U.S. PATENT DOCUMENTS 4,530,454 A * 7/1985 Gloor et al. ..... 227/129
4,964,558 A * 10/1990 Crutcher et al. ..... 227/8
5,118,023 A * 6/1992 Fushiya et al. ..... 227/8
5,320,270 A * 6/1994 Crutcher ..... 227/131
5,605,268 A * 2/1997 Hayashi et al. ..... 227/8
5,941,441 A * 8/1999 Ilagan ..... 227/131
6,669,072 B1 * 12/2003 Burke et al. ..... 227/131
6,766,935 B1 * 7/2004 Pedicini et al. ..... 227/131
6,971,567 B1 * 12/2005 Cannaliato et al. ..... 227/2
6,974,061 B1 * 12/2005 Adams et al. ..... 227/2

* cited by examiner

*Primary Examiner*—Scott A. Smith

(57) ABSTRACT

An electric nailing apparatus includes a triggering member, a rotatable rod member including first and second sustaining structures, a transmission rod having a first protrusion structure, a motor member and a ram block sustained against a fixture element via a resilience element. In response to a rotation of a gear member, the ram block glides to compress the resilience element and then touch the first protrusion structure. In response to an external force, the triggering member moves to have the first sustaining structure touch a first switch device to start the motor member. After the ram block touches the first protrusion structure, the second sustaining structure is simultaneously stirred by the transmission rod to have the first sustaining structure detached from the first switch device, thereby stopping the motor member and providing a nailing energy to the ram block in response to a recovery force of the resilience element.

20 Claims, 9 Drawing Sheets

ELECTRIC NAILING APPARATUS

FIELD OF THE INVENTION

The present invention relates to an electric nailing apparatus, and more particularly to an electric nailing apparatus not only capable of performing the nailing operation in one trigger/one shot manner, but capable of preventing from occurrence of dead point.

BACKGROUND OF THE INVENTION

Nowadays, with increasing development of electric nailing technologies, safety is a major concern. For sake of safety, there is a need to provide an electric nailing apparatus capable of performing the nailing operation in one trigger/one shot manner.

As known, in case of insufficient electricity or inadequate mechanical inertia, there may be a dead point during the conventional electric nailing apparatus is operated. Whenever there is a dead point, the housing of the electric nailing apparatus should be disassembled for restoring related components within the housing and then perform the next nailing operation. Therefore, the process for operating such an electric nailing apparatus is not user-friendly.

SUMMARY OF THE INVENTION

It is an object of the present invention to provide an electric nailing apparatus capable of performing the nailing operation in one trigger/one shot manner.

Another object of the present invention is to provide an electric nailing apparatus without occurrence of any dead point during operation.

In accordance with a first aspect of the present invention, there is provided an electric nailing apparatus. The electric nailing apparatus comprises a triggering member, a rotatable rod member, a transmission rod, a motor member and a ram block. The rotatable rod member is disposed between the triggering member and a first switch device and comprises first and second sustaining structures at different locations thereof. The transmission rod has thereon a first protrusion structure and is disposed in a receptacle member. The motor member is pivotally coupled to the lower portion of a gear member and electrically connected to the first switch device so as to drive the gear member. The ram block is disposed above the gear member and sustained against a fixture element via a resilience element. In response to a rotation of the gear member, the ram block glides to compress the resilience element and then touch the first protrusion structure. In response to an external force, the triggering member moves from a first location to a second location to have the first sustaining structure of the rotatable rod member sustained against a triggering point of the first switch device so as to start running of the motor member. After the ram block is in contact with the first protrusion structure, the second sustaining structure is simultaneously stirred by the transmission rod to have the first sustaining structure detached from the triggering point of the first switch device so as to stop running of the motor member and provide a nailing energy to the ram block in response to a recovery force of the resilience element.

In an embodiment, the resilience element is a spiral spring, and the rotatable rod member comprises a rod body and a grasping portion, the rod body including the first and second sustaining structures and a linking portion between the first and second sustaining structures and grasped by the grasping portion, wherein the first and second sustaining structures are respectively disposed at the bottom and top ends of the rod body and have an included angle therebetween.

In an embodiment, the included angle is 90 degree.

In an embodiment, the electric nailing apparatus further comprises a torsion spring wound around the linking portion between the first and second sustaining structures, wherein the rod body is recovered to an original state after the first sustaining structure is fully detached from the triggering point in response to a torsion force resulted from the torsion spring.

In an embodiment, the triggering member further comprises a protruding edge in contact with and urged against the grasping portion to have the rotatable rod member move in the direction toward the first switch device.

In an embodiment, the first protrusion structure is protruded from the bottom end of the transmission rod and extended above the gear member, and the periphery of the transmission rod is sheathed with a spiral spring, wherein the portion of the transmission rod sheathed with the spiral spring is disposed within the receptacle member, and the receptacle member comprises first and second receptacle portions.

In an embodiment, the first receptacle portion is disposed above the triggering member and at the front end of the transmission rod for accommodating the transmission rod, and the first receptacle portion has an opening for penetrating the top end of the transmission rod therethrough to be sustained against the second sustaining structure.

In an embodiment, the first transmission rod glides along a U-shaped gliding slot defined by two protrusion structures of the first receptacle portion, the second receptacle portion is disposed above the first switch device, and the rotatable rod member glides along a hollow U-shaped gliding slot defined by two extension structures of the second receptacle portion.

In an embodiment, the gear member comprises a drive gear and a driven gear engaged with the drive gear, and first and second rotary levers are protruded from the surfaces of the drive gear and the driven gear, respectively.

In an embodiment, the motor member is disposed under a supporting structure for supporting the gear member and pivotally coupled to the drive gear, the ram block is disposed at the front end of the transmission rod and above the gear member, and in response to successive stir actions of the first and second rotary levers, the ram block compresses the third resilience element and moves from the region above the drive gear to the region above the driven gear in the direction toward the first switch device and then touches the first protrusion structure.

In an embodiment, the ram block further includes an extension structure extended from a bottom surface thereof to touch and push the protrusion structure of the transmission rod, and two extension structures are extended from two opposite sides of the ram block and embedded into a track assembly to have the ram block glides along the track assembly and move on the region above the gear member forwardly and backwardly so as to compress the resilience element disposed in an accommodating cavity.

In an embodiment, the transmission rod further comprises a second protrusion structure disposed at the intersection of a left side and a bottom end of the transmission rod.

In an embodiment, the electric nailing apparatus further comprises a second switch device having a triggering point to be in contact with the second protrusion structure and electrically connected to the motor member.

In an embodiment, the gear member is continuously driven by the motor member after the ram block is in contact with the first protrusion structure so as to have the ram block move in the direction toward the first switch device, and before being detached from the effective stirring area of the second rotary lever, the second protrusion structure moves to be sustained against a triggering point of the second switch device so as to keep continuous running of the motor member and avoid occurrence of dead point.

In an embodiment, the resilience element is a spiral spring, and the motor member comprises a reduction gear box and a motor.

In accordance with a second aspect of the present invention, there is provided an electric nailing apparatus. The electric nailing apparatus comprises a triggering member, a rotatable rod member, a transmission rod, a motor member and a ram block. The triggering member is sustained against a first switch device via a first resilience element. The rotatable rod member is disposed between the triggering member and the first switch device and comprises first and second sustaining structures at different locations thereof. The transmission rod has thereon a first protrusion structure and disposed in a receptacle member, wherein the periphery thereof is sheathed with a second resilience element. The motor member is pivotally coupled to the lower portion of a gear member and electrically connected to the first switch device so as to drive the gear member. The ram block is disposed above the gear member and sustained against a fixture element via a third resilience element. In response to a rotation of the gear member, the ram block glides to compress the third resilience element and then touch the first protrusion structure. In response to an external force, the triggering member moves from a first location to a second location to compress the first resilience element between the triggering member and the first switch device and have the first sustaining structure of the rotatable rod member sustained against a triggering point of the first switch device so as to start running of the motor member. After the ram block is in contact with the first protrusion structure, the second resilience element in the receptacle member is gradually compressed and the second sustaining structure is simultaneously stirred by the transmission rod to have the first sustaining structure detached from the triggering point of the first switch device so as to stop running of the motor member and provide a nailing energy to the ram block in response to a recovery force of the resilience element.

In an embodiment, the first, second and third resilience elements are spiral springs.

In accordance with a third aspect of the present invention, there is provided an electric nailing apparatus. The electric nailing apparatus comprises a gear member, a motor member, a motor controlling assembly and a ram block. The gear member comprises a drive gear and a driven gear engaged with the drive gear, wherein first and second rotary levers are protruded from the surfaces of the drive gear and the driven gear, respectively. The motor member is pivotally coupled to the lower portion of the drive gear and electrically connected to a first switch device. The motor controlling assembly comprises first and second protrusion structures, is disposed between the gear member and the first switch device, and starts running of the motor member in response to an external force acting on the first switch device so as to have the primary and driven gears rotate. The ram block is disposed above the gear member and sustained against a fixture element via a first resilience element, wherein in response to successive stir actions of the first and the second rotary levers, the ram block compresses the third resilience element and moves from the region above the drive gear to the region above the driven gear in the direction toward the first switch device and then touches the first protrusion structure. The switch device has a triggering point to be in contact with the second protrusion structure, and is electrically connected to the motor member. Especially, the gear member is continuously driven by the motor member after the ram block is in contact with the first protrusion structure so as to have the ram block move in the direction toward the first switch device. In addition, before being detached from the effective stirring area of the second rotary lever, the second protrusion structure moves to be sustained against a triggering point of the second switch device so as to keep continuous running of the motor member and avoid occurrence of dead point.

In an embodiment, the motor controlling assembly further comprises a triggering member, a rotatable rod member and a transmission rod. The triggering member is sustained against a first switch device via a second resilience element. The rotatable rod member is disposed between the triggering member and the first switch device and comprises first and second sustaining structures at different locations thereof. The transmission rod has thereon a first protrusion structure and is disposed in a receptacle member, wherein the periphery thereof is sheathed with a third resilience element. In response to an external force, the triggering member moves from a first location to a second location to compress the second resilience element between the triggering member and the first switch device and have the first sustaining structure of the rotatable rod member sustained against the triggering point of the first switch device so as to start running of the motor member. After the ram block is in contact with the first protrusion structure, the third resilience element in the receptacle member is gradually compressed and the second sustaining structure is simultaneously stirred by the transmission rod to have the first sustaining structure detached from the triggering point of the first switch device so as to stop running of the motor member and provide a nailing energy to the ram block in response to a recovery force of the resilience element.

The above contents of the present invention will become more readily apparent to those ordinarily skilled in the art after reviewing the following detailed description and accompanying drawings, in which:

DETAILED DESCRIPTION OF THE PREFERRED EMBODIMENT

Figure 1:
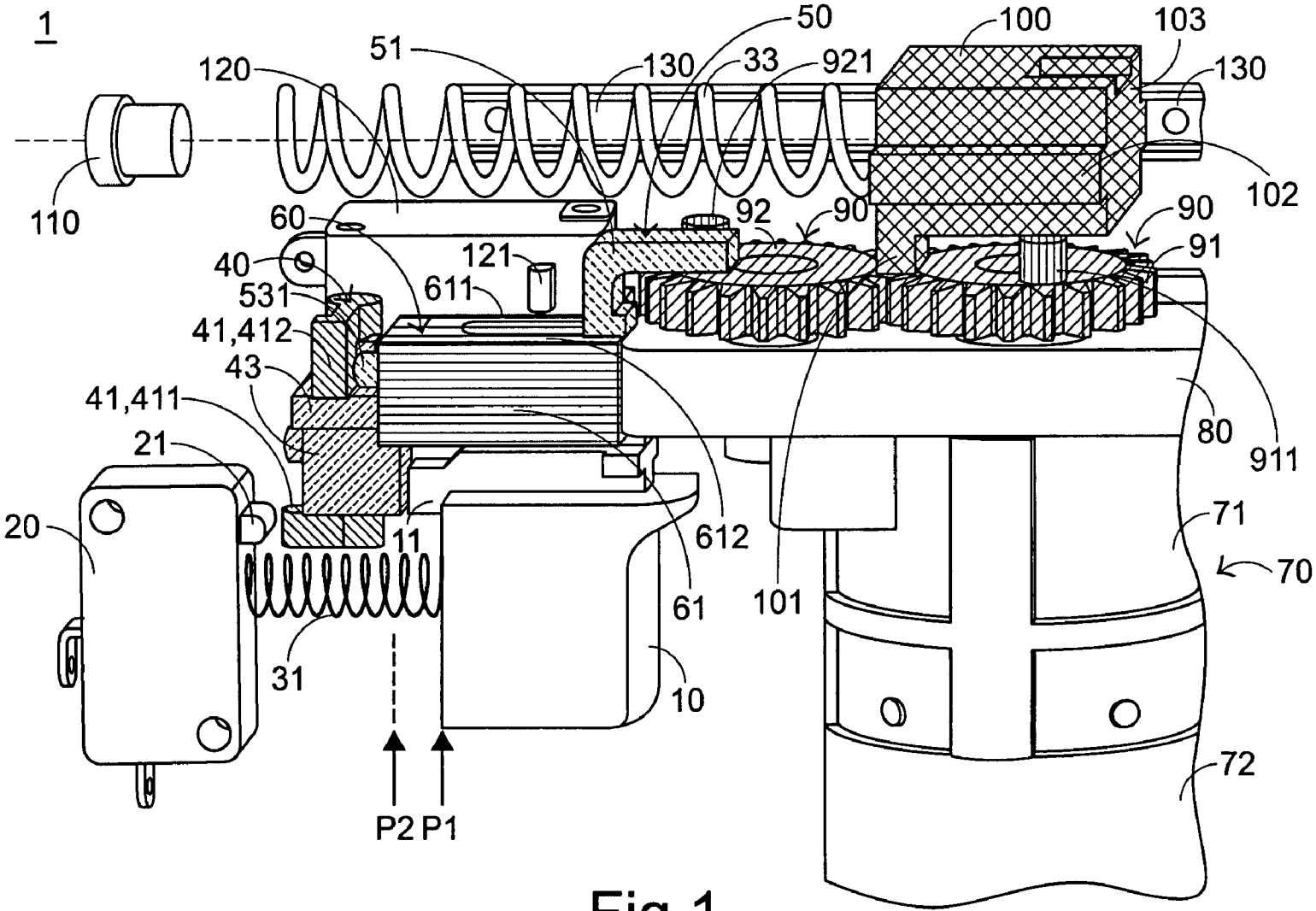
FIG. 1 schematically illustrates an electric nailing apparatus according to a preferred embodiment of the present invention in a ready-to-nail state.

The present invention will now be described more specifically with reference to the following embodiments. FIG. 1 schematically illustrates an electric nailing apparatus according to a preferred embodiment of the present invention in a ready-to-nail state. Whereas, FIGS. 2~7 are schematic operation diagrams of the electric nailing apparatus.

It is to be noted that the following descriptions of preferred embodiments of this invention are presented herein for purpose of illustration and description only. It is not intended to be exhaustive or to be limited to the precise form disclosed.

Please refer to FIGS. 1 to 7, which illustrate an electric nailing apparatus according to a preferred embodiment of the present invention. The electric nailing apparatus 1 comprises at least a triggering member 10, a rotatable rod member 40, a transmission rod 50, a motor member 70 and a ram block 100. The triggering member 10 is sustained against a first switch device 20 via a first resilience element 31. The rotatable rod member 40 is disposed between the triggering member 10 and the first switch device 20, and includes a first sustaining structure 411 and a second sustaining structure 412 at different locations thereof. The transmission rod 50 has thereon a first protrusion structure 51 and is disposed in a receptacle member 60. The periphery of the transmission rod 50 is sheathed with a second resilience element 32. The motor member 70 is pivotally coupled to the lower portion of a gear member 90. The motor member 70 is also electrically connected to the first switch device 20 so as to drive the gear member 90. The ram block 100 is disposed above the gear member 90 and sustained against a fixture element 110 via a third resilience element 33. In response to the rotation of the gear member 90, the ram block 100 glides to compress the third resilience element 33 and then touch the first protrusion structure 51. According to the present invention, the resilience elements 31, 32 and 33 are preferably spiral springs.

The detailed structures of the related elements in FIGS. 1~7 will be illustrated as follows.

Figure 7:
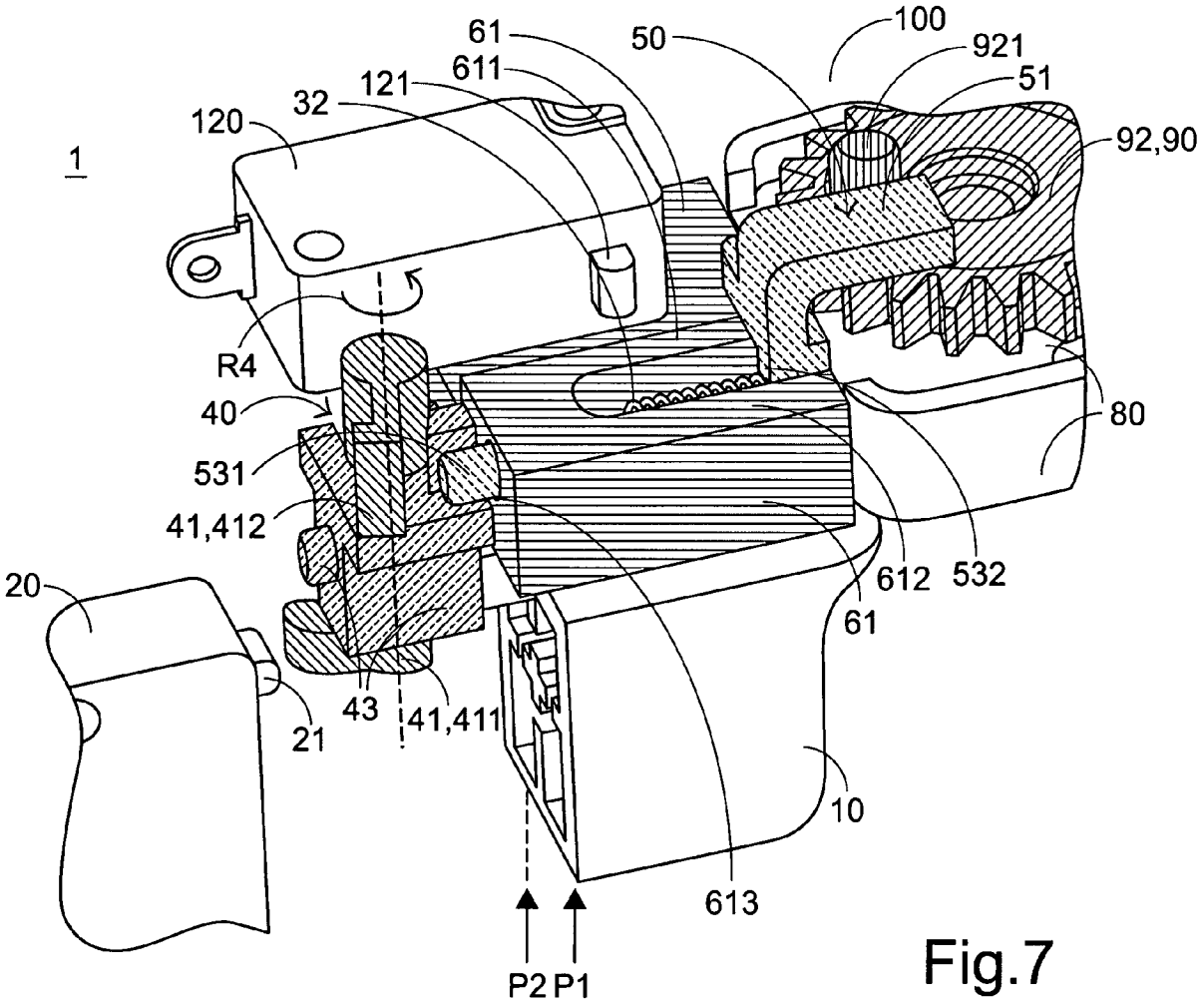
FIG. 7 is a schematic operation diagram illustrating the movement of the triggering member from the second location to the first location after the external force is relieved.
Figure 9:
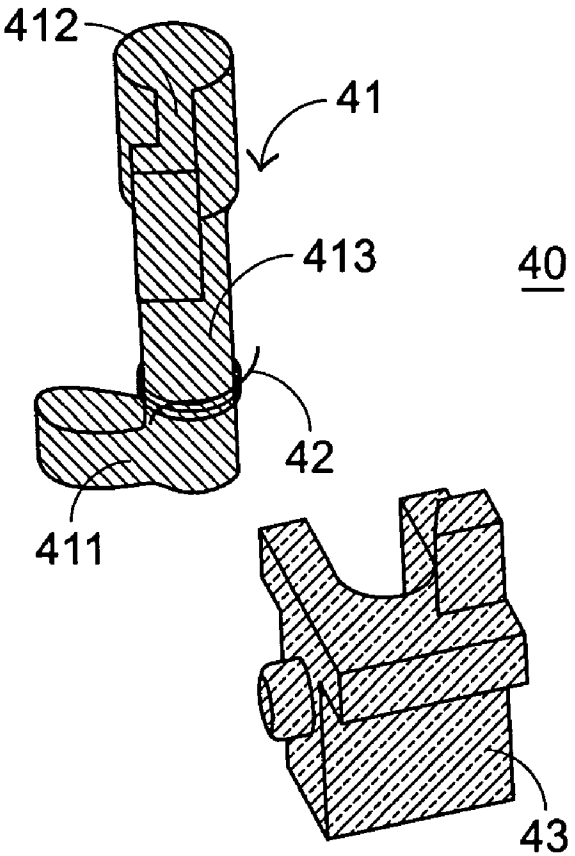
FIG. 9 is schematic perspective view of the rotatable rod member used in the present invention.

The rotatable rod member 40 comprises a rod body 41 and a grasping portion 43, as is clearly shown in FIG. 9. The rod body 41 comprises the first sustaining structure 411, the second sustaining structure 412 and a linking portion 413. The linking portion 413 is disposed between the first sustaining structure 411 and the second sustaining structure 412, and grasped by the grasping portion 43. The first sustaining structure 411 and the second sustaining structure 412 are disposed at the bottom and top ends of the rod body 41, respectively, and preferably perpendicular to each other. By the way, an arbitrary included angle between the first sustaining structure 411 and the second sustaining structure 412 and the arrangement thereof may be desired. A torsion spring 42 is wound around the linking portion 413 for providing a torsion force to the linking portion 413. As shown in FIG. 7, after the first sustaining structure 411 is fully detached from the triggering point 21 of the first switch device 20, the rod body 41 will return to the original state by the torsion force generated from the torsion spring 42.

Figure 2:
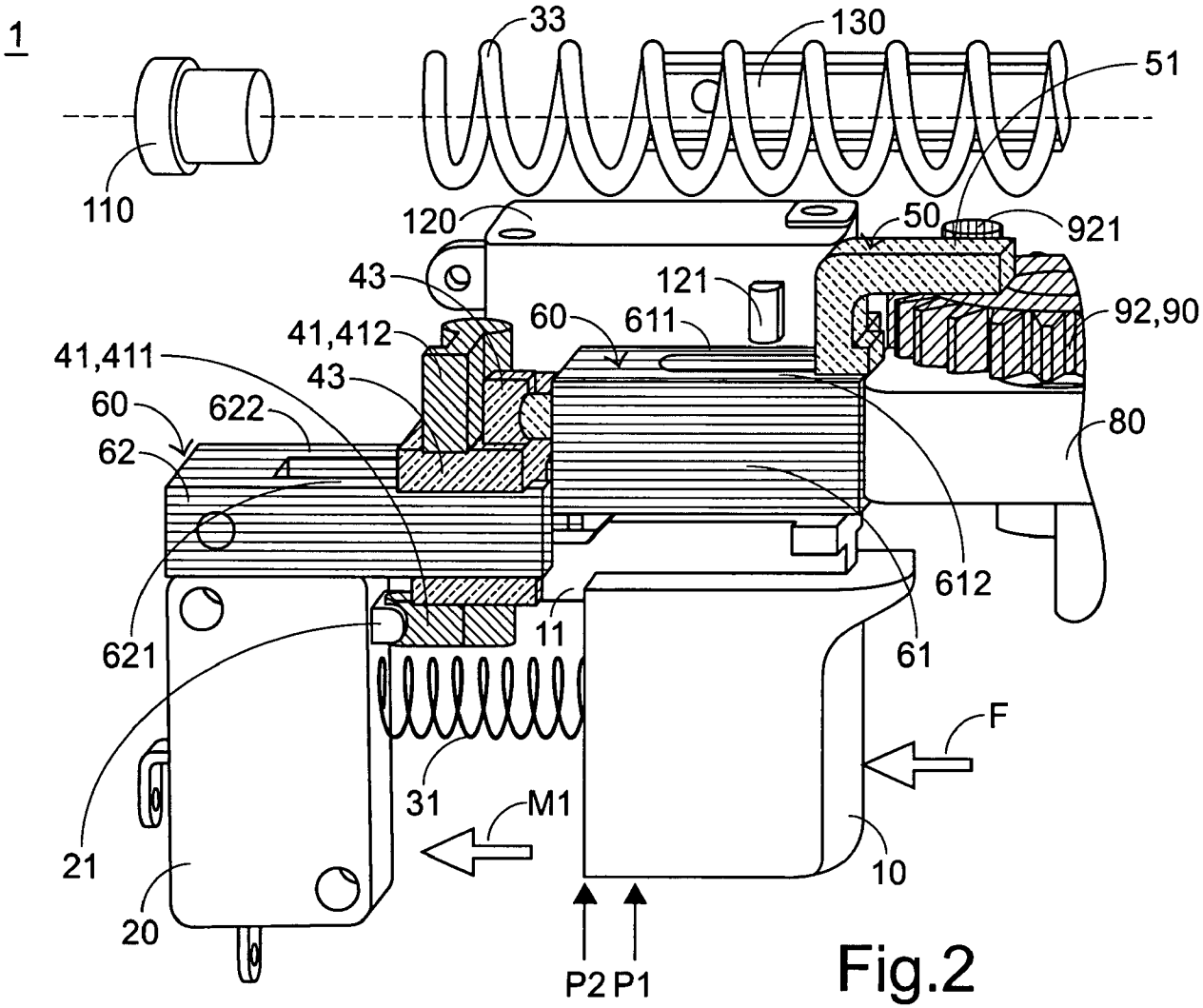
FIG. 2 is a schematic operation diagram illustrating the movement of the triggering member from a first location to a second location in response to an external force.

The triggering member 10 further comprises a protruding edge 11 in contact with and urged against the grasping portion 43 so as to have the rotatable rod member 40 move in the direction M1 toward the first switch device 20, as can be seen in FIG. 2.

Figure 3:
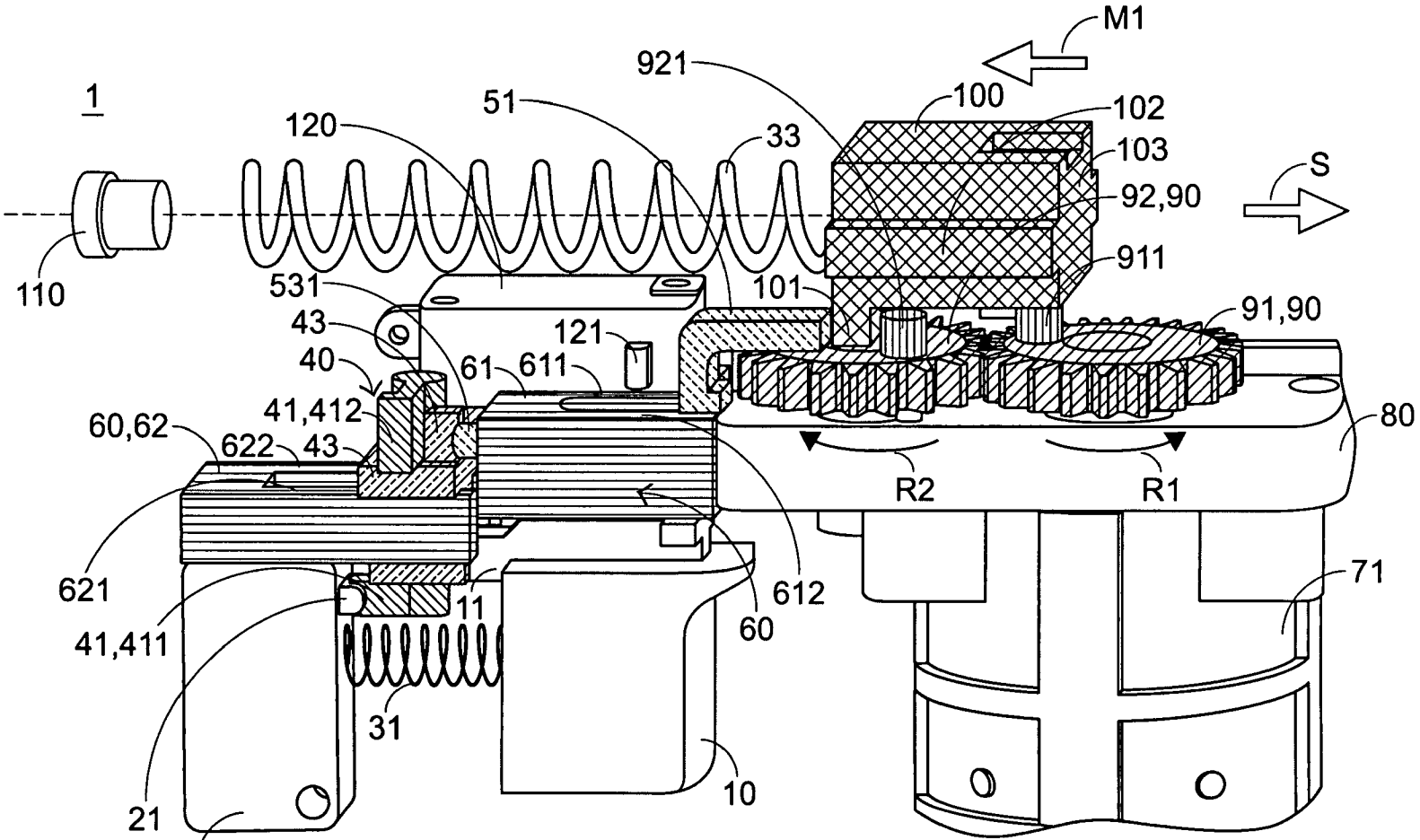
FIG. 3 is a schematic operation diagram illustrating the movement of the ram block along the regions above the gear member in response to the successive stir actions of the first rotary lever and the second rotary lever.
Figure 8:
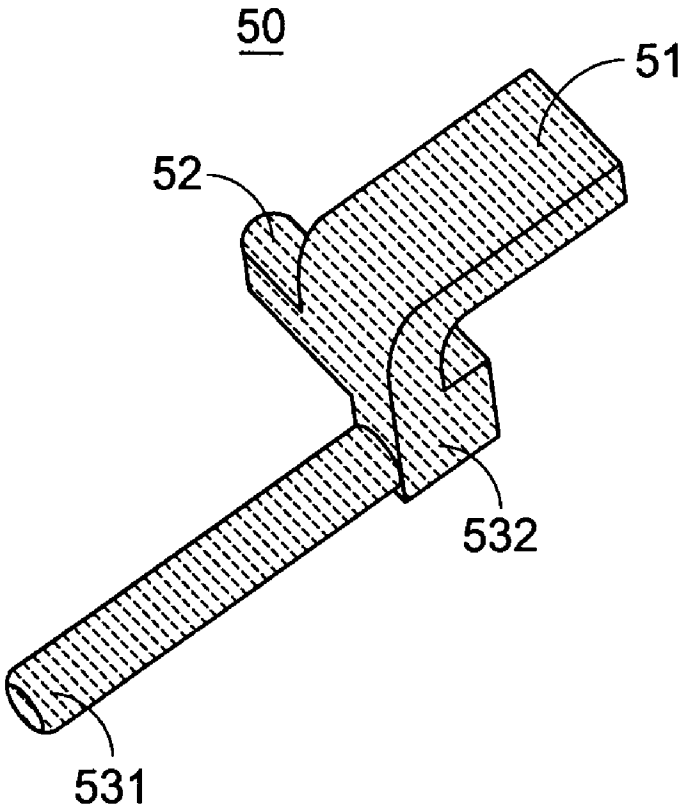
FIG. 8 is schematic perspective view of the transmission rod used in the present invention.

Please also refer to FIG. 8, which is perspective view of the transmission rod 50. The first protrusion structure 51 is protruded from the bottom end 532 of the transmission rod 50 and extended above the gear member 90. The periphery of the transmission rod 50 is sheathed with the second resilience element 32. The portion of the transmission rod 50 sheathed with the second resilience element 32 is disposed within the receptacle member 60. In an embodiment, the receptacle member 60 comprises a first receptacle portion 61 and a second receptacle portion 62. The first receptacle portion 61 is disposed above the triggering member 10 and at the front end of the grasping portion 43 for accommodating the transmission rod 50. In addition, the first receptacle portion 61 has an opening 613 for penetrating the top end 531 of the transmission rod 50 therethrough to be sustained against the second sustaining structure 412. The transmission rod 50 glides along a U-shaped gliding slot defined by two protrusion structures 611 and 612 of the first receptacle portion 61. The second receptacle portion 62 as shown in FIGS. 2 and 3 is disposed above the first switch device 20. The rotatable rod member 40 glides along a hollow U-shaped gliding slot defined by two extension structures 621 and 622 of the second receptacle portion 62.

In a preferred embodiment, the gear member 90 is supported on a supporting structure 80, and comprises a drive gear 91 and a driven gear 92 engaged with the drive gear 91. A first rotary lever 911 and a second rotary lever 921 are protruded from the surfaces of the drive gear 91 and the driven gear 92, respectively. The motor member 70 is disposed under the supporting structure 80 and pivotally coupled to the drive gear 91. Preferably, the motor member 70 comprises a reduction gear box 71 and a motor 72.

Figure 5:
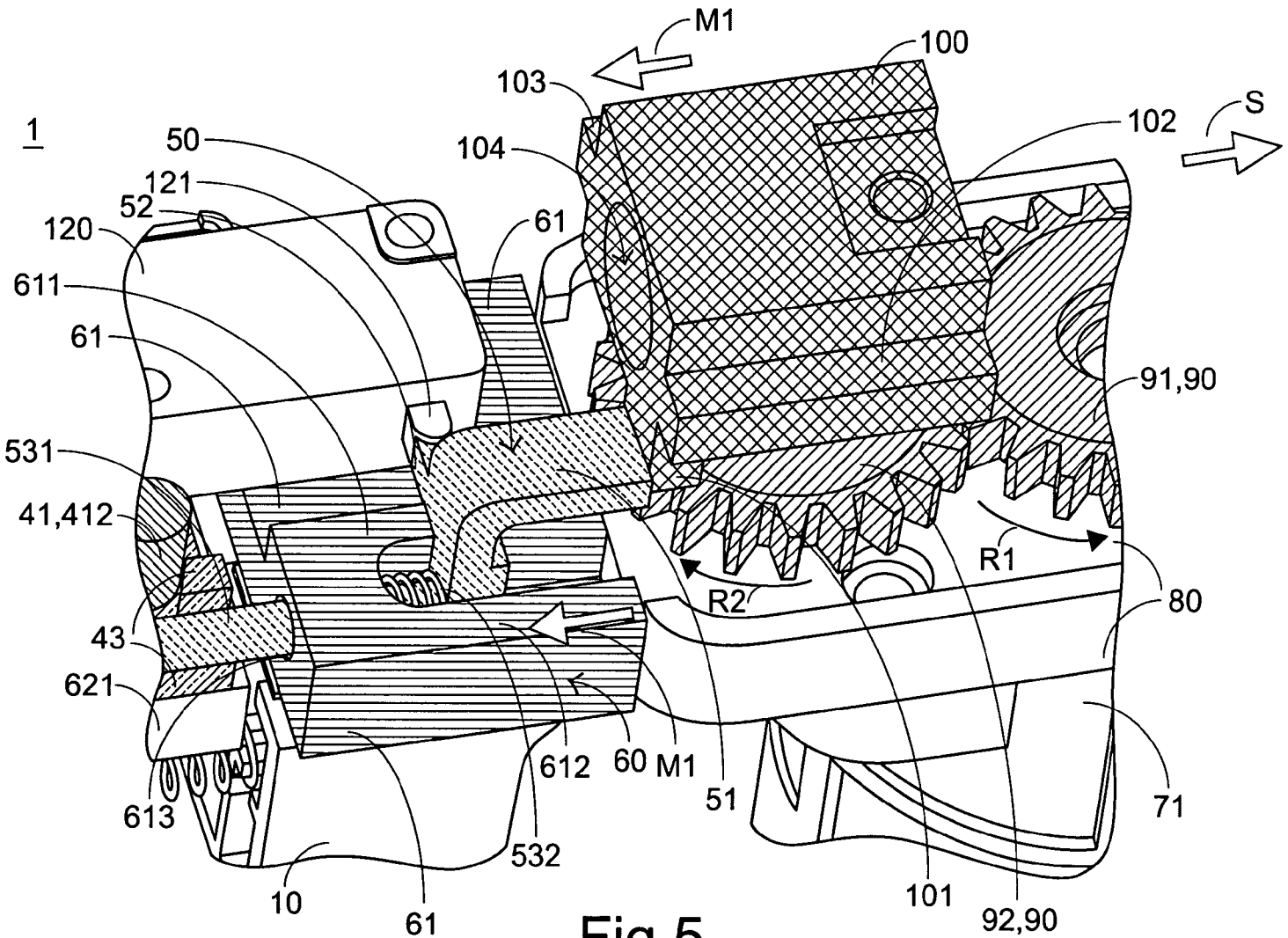
FIG. 5 is a schematic operation diagram illustrating the movement of the second protrusion structure to be sustained against the triggering point of the second switch device.
Figure 6:
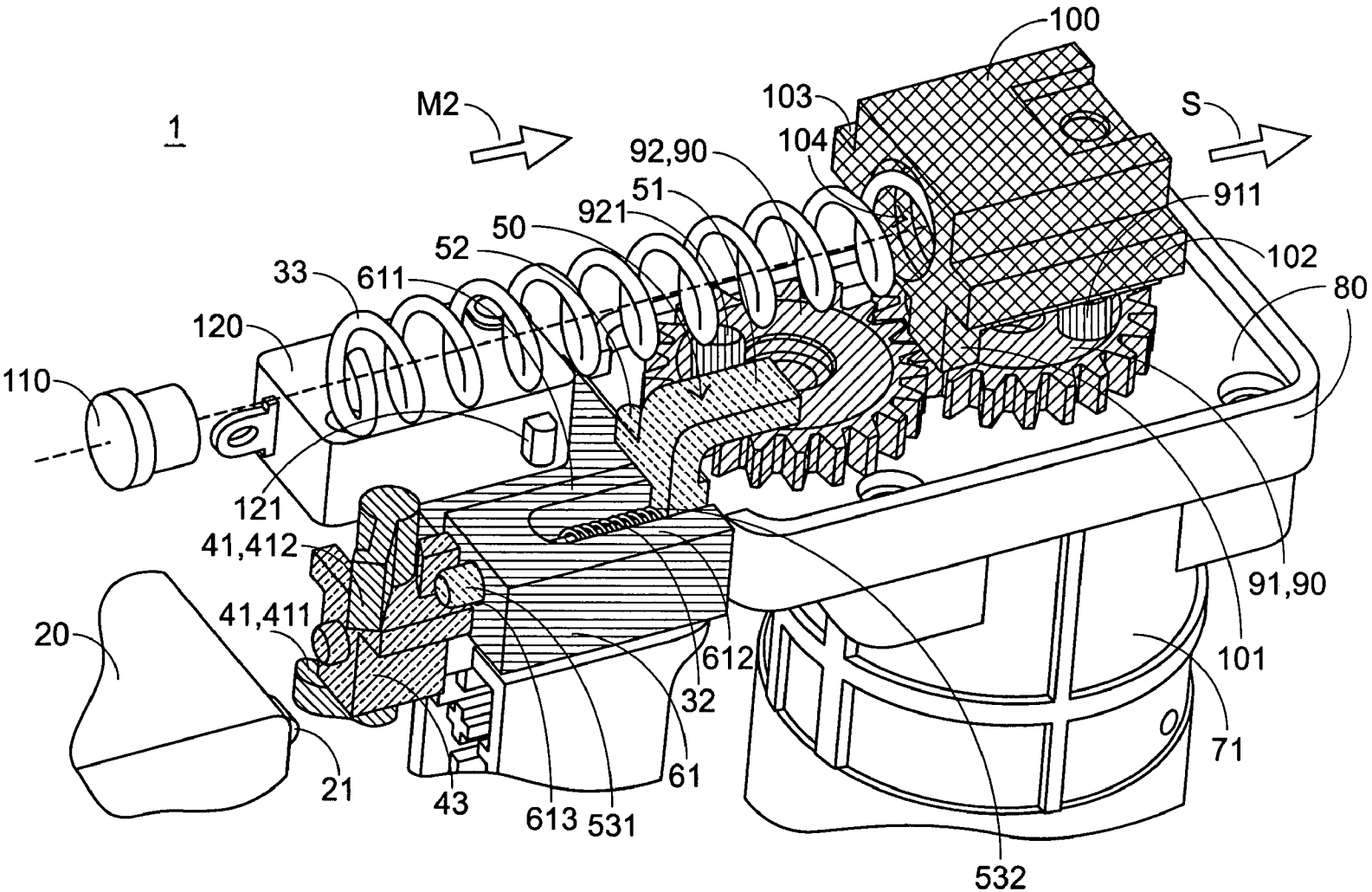
FIG. 6 is a schematic operation diagram illustrating that after the ram block is fully detached from the effective stirring area of the second rotary lever, in response to a recovery force of the third resilience element, the ram block perform a nailing action.

In a preferred embodiment, the ram block 100 is disposed at the front end of the transmission rod 50 and above the gear member 90. In response to successive stir actions of the first rotary lever 911 and the second rotary lever 921, the ram block 100 will compress the third resilience element 33 between the fixture element 110 and an accommodating cavity 104 (as shown in FIGS. 5 and 6), and move from the region above the drive gear 91 in the direction M1 toward the first switch device 20. Afterward, the ram block 100 moves to the region above the driven gear 92 and then touches the first protrusion structure 51. In addition, the ram block 100 further includes an extension structure 101 extended from a bottom surface thereof to be in contact with and push the first protrusion structure 51 of the transmission rod 50. Two extension structures 102 and 103 are extended from two opposite sides of the ram block 100 and embedded into a track assembly 130 (as shown in FIGS. 1 and 2). Since the extension structures 102 and 103 of the embedded into the track assembly 130, the ram block 100 will glide along the track assembly 130 so as to move on the region above the gear member 90 forwardly and backwardly. In FIGS. 1 and 2, only the extension structure 103 of the ram block 100 embedded in the track assembly 130 is shown in the drawings for purposes of clarity. The engagement of the extension structure 102 with the track assembly 130 is identical to that of the extension structure 103 with the track assembly 130, and is not to be redundantly described herein.

Especially, the transmission rod 50 further comprises a second protrusion structure 52 disposed at the intersection of a left side and the bottom end 532 of the transmission rod 50. Moreover, the electric nailing apparatus 1 comprises a second switch device 120 in contact with the second protrusion structure 52. The second switch device 120 has a triggering point 121 and is electrically connected to the motor member 70. The second protrusion structure 52 and second switch device 120 cooperatively facilitates avoiding occurrence of the dead point.

The operation principle of the electric nailing apparatus according to the present invention will be illustrated as follows.

Please again refer to FIG. 2, which is a schematic operation diagram illustrating the movement of the triggering member 10 from a first location P1 to a second location P2 in response to an external force F. On the other hand, when the triggering member 10 moves from the first location P1 to the second location P2 in response to the external force F, the first resilience element 31 is compressed and the rotatable rod member 40 is pushed by the protruding edge 11 of the triggering member 10. In such way, the first sustaining structure 411 is sustained against the triggering point 21 of the first switch device 20 so as to start the motor member 70, which is electrically connected to the first switch device 20.

Figure 4:
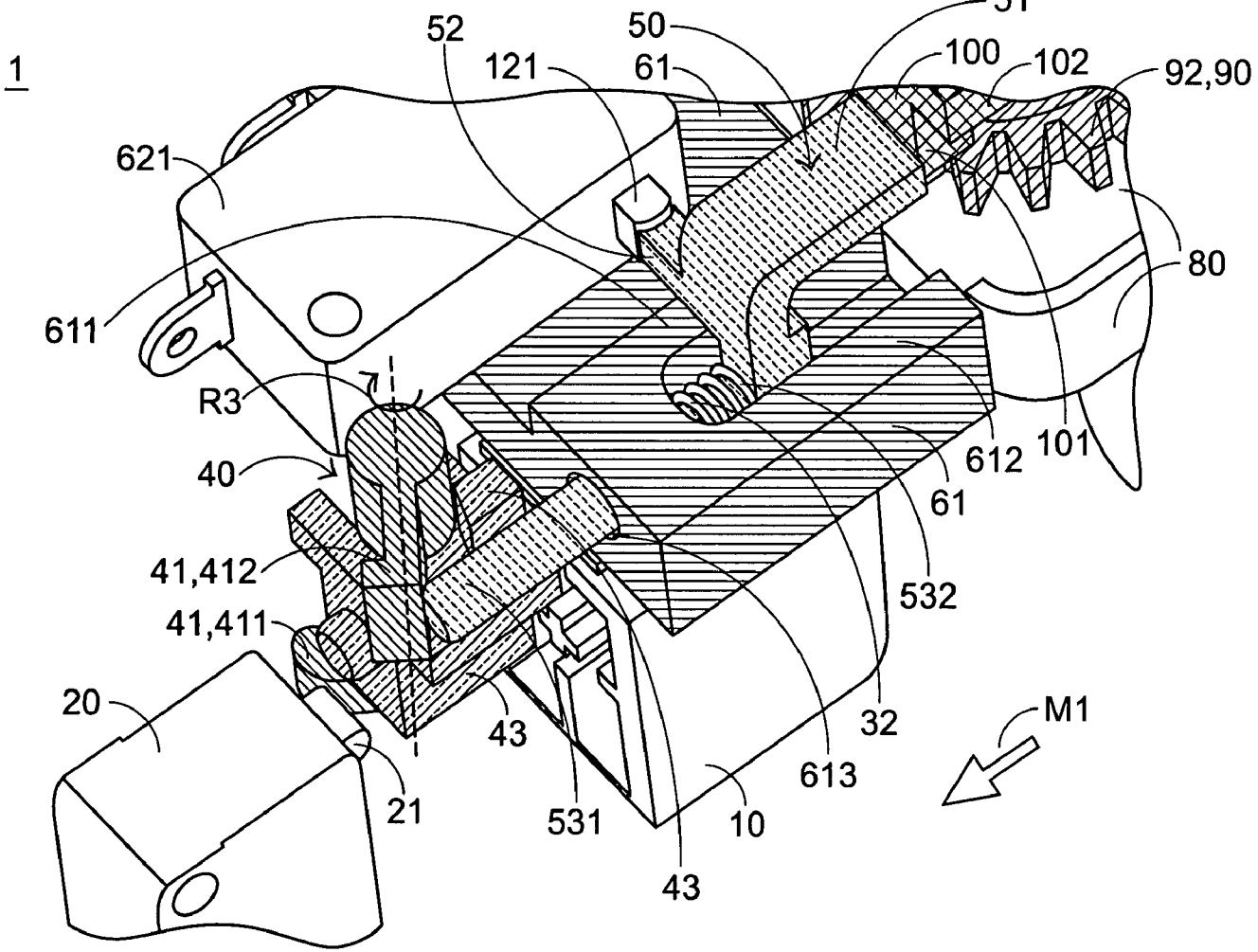
FIG. 4 is a schematic operation diagram illustrating that the top end of the transmission rod is sustained against the second sustaining structure such that the first sustaining structure is detached from the triggering point of the first switch device.

Please again refer to FIG. 3, which is a schematic operation diagram illustrating the movement of the ram block 100 along the regions above the gear member 90 in response to the successive stir actions of the first rotary lever 911 and the second rotary lever 921. As shown in FIGS. 3 and 4, after the motor member 70 starts running, in response to an anti-clockwise rotation R1 of the drive gear 91 and a simultaneously clockwise rotation R2 of the driven gear 92, the first rotary lever 911 is driven to stir the extension structure 101 of the ram block 100 such that the ram block 100 moves in the direction M1 toward the first switch device 20. Before being detached from the effective stirring area of the first rotary lever 911, the extension structure 101 of the ram block 100 is successively stirred by the second rotary lever 921 such that the ram block 100 is continuously moved in the direction M1 toward the first switch device 20. In such way, the ram block 100 moves from the region above the drive gear 91 to the region above the driven gear 92 in the direction M1 toward the first switch device 20, and then touches the first protrusion structure 51.

Meanwhile, as shown in FIG. 4, the top end 531 of the transmission rod 50 is sustained against the second sustaining structure 412 such that the first sustaining structure 411 is detached from the triggering point 21 of the first switch device 20. In other words, since the ram block 100 continuously pushes the first protrusion structure 51, the second resilience element 32 in the first receptacle portion 61 is gradually compressed. Simultaneously, the second sustaining structure 412 is stirred to rotate in an anti-clockwise rotation R3 by the transmission rod 50. Thus, the first sustaining structure 411 under the rod body 41 will be detached from the triggering point 21 of the first switch device 20 so as to stop running of the motor member 70. Meanwhile, by the compression of the ram block 100, nailing energy is gradually accumulated in the third resilience element 33 shown in FIGS. 1~3.

Please again refer to FIG. 5, which is a schematic operation diagram illustrating the movement of the second protrusion structure 52 to be sustained against the triggering point 121 of the second switch device 120. After the ram block 100 is in contact with the first protrusion structure 51, by means of the motor member 70, the gear member 90 is continuously driven such that the ram block 100 is pushed to move in the direction M1 toward the first switch device 20. Before being detached from the effective stirring area of the second rotary lever 921, the second protrusion structure 52 will moves to be sustained against the triggering point 121 of the second switch device 120 so as to keep continuous running of the motor member 70 and avoid occurrence of dead point.

As shown in FIG. 6, once the ram block 100 is fully detached from the effective stirring area of the second rotary lever 921, the nailing energy accumulated in the third resilience element 33 will result in a recovery force to push the ram block 100 to move in the opposite direction M2 so as to perform a nailing action S.

After the external force F as shown in FIG. 2 is relieved, the recovery force generated from the first resilience element 31 will push the triggering member 10 to move from the second location P2 to the first location P1. In addition, due to the torsion force generated from the torsion spring 42 wound around the rod body 41, when the first sustaining structure 411 is fully detached from the triggering point 21 of the first switch device 20, the rod body 41 will be rotated in an anti-clockwise rotation R4 to return its original state. The operation diagram illustrating the movement of the triggering member 10 from the second location P2 to the first location P1 is shown in FIG. 7.

By the way, the triggering member 10, the rotatable rod member 40 and the transmission rod 50 can be integrated into a motor controlling assembly. Those skilled in the art will readily observe that numerous modifications and alterations of the motor controlling assembly may be made while retaining the teachings of the invention. Accordingly, the above disclosure should be limited only by the bounds of the following claims.

From the above description, the electric nailing apparatus is not only capable of performing the nailing operation in one trigger/one shot manner, but capable of preventing from occurrence of dead point.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electric nailing apparatus comprising:

a triggering member;

a rotatable rod member disposed between said triggering member and a first switch device and comprising first and second sustaining structures at different locations thereof;

a transmission rod having thereon a first protrusion structure and disposed in a receptacle member;

a motor member pivotally coupled to the lower portion of a gear member and electrically connected to said first switch device so as to drive said gear member; and a ram block disposed above said gear member, sustained against a fixture element via a resilience element, and in response to a rotation of said gear member, gliding to compress said resilience element and then touch said first protrusion structure, wherein in response to an external force, said triggering member moves from a first location to a second location to have said first sustaining structure of said rotatable rod member sustained against a triggering point of said first switch device so as to start running of said motor member, and after said ram block is in contact with said first protrusion structure, said second sustaining structure is simultaneously stirred by said transmission rod to have said first sustaining structure detached from said triggering point of said first switch device so as to stop running of said motor member and provide a nailing energy to said ram block in response to a recovery force of said resilience element.

2. The electric nailing apparatus according to claim 1 wherein said resilience element is a spiral spring, and said rotatable rod member comprises a rod body and a grasping portion, said rod body including said first and second sustaining structures and a linking portion between said first and second sustaining structures and grasped by said grasping portion, wherein said first and second sustaining structures are respectively disposed at the bottom and top ends of said rod body and have an included angle therebetween.

3. The electric nailing apparatus according to claim 2 wherein said included angle is 90 degree.

4. The electric nailing apparatus according to claim 2 further comprising a torsion spring wound around said linking portion between said first and second sustaining structures, wherein said rod body is recovered to an original state after said first sustaining structure is fully detached from said triggering point in response to a torsion force resulted from said torsion spring.

5. The electric nailing apparatus according to claim 2 wherein said triggering member further comprises a protruding edge in contact with and urged against said grasping portion to have said rotatable rod member move in the direction toward said first switch device.

6. The electric nailing apparatus according to claim 1 wherein said first protrusion structure is protruded from the bottom end of said transmission rod and extended above said gear member, and the periphery of said transmission rod is sheathed with a spiral spring, wherein the portion of said transmission rod sheathed with said spiral spring is disposed within said receptacle member, and said receptacle member comprises first and second receptacle portions.

7. The electric nailing apparatus according to claim 6 wherein said first receptacle portion is disposed above said triggering member and at the front end of said transmission rod for accommodating said transmission rod, and said first receptacle portion has an opening for penetrating the top end of said transmission rod therethrough to be sustained against said second sustaining structure.

8. The electric nailing apparatus according to claim 6 wherein said first transmission rod glides along a U-shaped gliding slot defined by two protrusion structures of said first receptacle portion, said second receptacle portion is disposed above said first switch device, and said rotatable rod member glides along a hollow U-shaped gliding slot defined by two extension structures of said second receptacle portion.

9. The electric nailing apparatus according to claim 1 wherein said gear member comprises a drive gear and a driven gear engaged with the drive gear, and first and second rotary levers are protruded from the surfaces of said drive gear and said driven gear, respectively.

10. The electric nailing apparatus according to claim 9 wherein said motor member is disposed under a supporting structure for supporting said gear member and pivotally coupled to said drive gear, said ram block is disposed at the front end of said transmission rod and above said gear member, and in response to successive stir actions of said first and second rotary levers, said ram block compresses said third resilience element and moves from the region above said drive gear to the region above said driven gear in the direction toward said first switch device and then touches said first protrusion structure.

11. The electric nailing apparatus according to claim 10 wherein said ram block further includes an extension structure extended from a bottom surface thereof to touch and push said protrusion structure of said transmission rod, and two extension structures are extended from two opposite sides of said ram block and embedded into a track assembly to have said ram block glides along said track assembly and move on the region above said gear member forwardly and backwardly so as to compress said resilience element disposed in an accommodating cavity.

12. The electric nailing apparatus according to claim 10 wherein said transmission rod further comprises a second protrusion structure disposed at the intersection of a left side and a bottom end of said transmission rod.

13. The electric nailing apparatus according to claim 12 further comprising a second switch device having a triggering point to be in contact with said second protrusion structure and electrically connected to said motor member.

14. The electric nailing apparatus according to claim 13 wherein said gear member is continuously driven by said motor member after said ram block is in contact with said first protrusion structure so as to have said ram block move in the direction toward said first switch device, and before being detached from the effective stirring area of said second rotary lever, said second protrusion structure moves to be sustained against a triggering point of said second switch device so as to keep continuous running of said motor member and avoid occurrence of dead point.

15. The electric nailing apparatus according to claim 1 wherein said resilience element is a spiral spring, and said motor member comprises a reduction gear box and a motor.

16. An electric nailing apparatus comprising:

a triggering member sustained against a first switch device via a first resilience element a rotatable rod member disposed between said triggering member and said first switch device and comprising first and second sustaining structures at different locations thereof;

a transmission rod having thereon a first protrusion structure and disposed in a receptacle member, the periphery thereof being sheathed with a second resilience element;

a motor member pivotally coupled to the lower portion of a gear member and electrically connected to said first switch device so as to drive said gear member; and a ram block disposed above said gear member, sustained against a fixture element via a third resilience element, and in response to a rotation of said gear member, gliding to compress said third resilience element and then touch said first protrusion structure, wherein in response to an external force, said triggering member moves from a first location to a second location to compress said first resilience element between said triggering member and said first switch device and have said first sustaining structure of said rotatable rod member sustained against a triggering point of said first switch device so as to start running of said motor member, and after said ram block is in contact with said first protrusion structure, said second resilience element in said receptacle member is gradually compressed and said second sustaining structure is simultaneously stirred by said transmission rod to have said first sustaining structure detached from said triggering point of said first switch device so as to stop running of said motor member and provide a nailing energy to said ram block in response to a recovery force of said resilience element.

17. The electric nailing apparatus according to claim 16 wherein said first, second and third resilience elements are spiral springs.

18. An electric nailing apparatus comprising:

a gear member comprising a drive gear and a driven gear engaged with said drive gear, wherein first and second rotary levers are protruded from the surfaces of said drive gear and said driven gear, respectively;

a motor member pivotally coupled to the lower portion of said drive gear and electrically connected to a first switch device;

a motor controlling assembly comprising first and second protrusion structures, disposed between said gear member and said first switch device, and starting running of said motor member in response to an external force acting on said first switch device so as to have said primary and driven gears rotate; and a ram block disposed above said gear member and sustained against a fixture element via a first resilience element, wherein in response to successive stir actions of said first and the second rotary levers, said ram block compresses said third resilience element and moves from the region above said drive gear to the region above said driven gear in the direction toward said first switch device and then touches said first protrusion structure; and a switch device having a triggering point to be in contact with said second protrusion structure, and electrically connected to said motor member, wherein said gear member is continuously driven by said motor member after said ram block is in contact with said first protrusion structure so as to have said ram block move in the direction toward said first switch device, and before being detached from the effective stirring area of said second rotary lever, said second protrusion structure moves to be sustained against a triggering point of said second switch device so as to keep continuous running of said motor member and avoid occurrence of dead point.

19. The electric nailing apparatus according to claim 18 wherein said motor controlling assembly further comprises:

a triggering member sustained against a first switch device via a second resilience element;

a rotatable rod member disposed between said triggering member and said first switch device and comprising first and second sustaining structures at different locations thereof; and a transmission rod having thereon a first protrusion structure and disposed in a receptacle member, the periphery thereof being sheathed with a third resilience element;

wherein in response to an external force, said triggering member moves from a first location to a second location to compress said second resilience element between said triggering member and said first switch device and have said first sustaining structure of said rotatable rod member sustained against said triggering point of said first switch device so as to start running of said motor member, and after said ram block is in contact with said first protrusion structure, said third resilience element in said receptacle member is gradually compressed and said second sustaining structure is simultaneously stirred by said transmission rod to have said first sustaining structure detached from said triggering point of said first switch device so as to stop running of said motor member and provide a nailing energy to said ram block in response to a recovery force of said resilience element.

20. The electric nailing apparatus according to claim 19 wherein said first, second and third resilience elements are spiral springs, and said motor member comprises a reduction gear box and a motor.

* * * * *